United States Patent [19]

Tindal

[11] 4,125,081

[45] Nov. 14, 1978

[54] BOAT

[76] Inventor: Bobby G. Tindal, Rte. 1, Pelion, S.C. 29123

[21] Appl. No.: 837,614

[22] Filed: Sep. 28, 1977

[51] Int. Cl.[2] ..... B63H 25/00

[52] U.S. Cl. ..... 114/153; 9/7; 115/18 R

[58] Field of Search ..... 114/144 R, 144 A, 153; 115/17, 18 R, 18 E, 24, 25; 74/480 B, 481; 9/1.1, 6 R, 6 M, 6 P, 6 W, 7

[56] References Cited

U.S. PATENT DOCUMENTS

| | | | |
|---|---|---|---|
| 430,218 | 6/1890 | O'Leary | 9/7.0 |
| 1,718,764 | 6/1929 | Sochurek | 9/6M |
| 2,473,874 | 6/1949 | Ganong | 9/1.1 |
| 2,668,513 | 2/1954 | Reynolds | 115/25 |
| 2,727,630 | 8/1956 | Ottinger | 115/18 R |
| 3,013,518 | 12/1961 | Smith | 115/18 E |
| 3,052,204 | 9/1962 | Scivally | 115/18 E |
| 3,163,409 | 12/1964 | Running et al. | 9/7 |
| 3,659,475 | 5/1972 | Nichols | 115/18 R |

*Primary Examiner*—Trygve M. Blix
*Assistant Examiner*—Jesus D. Sotelo
*Attorney, Agent, or Firm*—Larry Harold Kline

[57] ABSTRACT

A boat which may be operated by one person and which comprises a power source, a seat hingedly secured to the boat, a foot control steering apparatus, and cable connected from the foot control steering apparatus through the seat to the power source.

23 Claims, 7 Drawing Figures

BOAT

This invention relates to a boat and more particularly to a small boat easily controlled by one person.

The present inventor has previously patented a Controlled One Man Boat, U.S. Pat. No. 4,022,145. The present specification contains many improvements and refinements of the previous invention. These improvements solved many problems and solved many objectives which are desirable for the boat.

An object of the present invention is to provide a boat which has directional controls which are foot activated with good stability for the person operating the boat.

Another object of the present invention is to provide a boat which may be operated by one person with a seat hingedly secured to the boat for ease in folding the seat in preparation for transporting or storage.

Still another object of the present invention is to provide a boat with a hingedly secured seat and foot control steering means.

Another object of the present invention is to provide a boat which may be operated by one person which is very stable and which is very convenient.

These and other objects and features of the invention will be apparent from the following description and appended claims.

Briefly, the invention is a boat which may be operated by one person. The boat comprises a removeably attached power source operative to drive the boat, a seat hingedly secured to the boat, foot control steering means removeably attached to the boat, and cable means connected from the foot control steering means through the seat to the power source. The boat may be maneuvered by use of the foot control steering means. The preparation for transporting or storing the boat may include removing the foot control means, folding the hingedly secured seat and removing the power source. The boat may have a wet storage compartment suitable for storing live fish and/or bait. The wet storage compartment may be positioned in the boat between the legs of the person operating the boat. The boat has a lip on the bow operative to prevent wakes from blowing over the front of the boat. Switch means may be located on the outer portion of the boat in order to conveniently control the power source. A stabilizing lip may completely surround the boat in order to further stabilize it. A pulley is secured to the power source. A slot in the pulley is used in aligning the foot control steering means with the power source. A center adjustment piece is secured onto the cable means and is operative to aid in aligning the foot control steering means with the power source. The center adjustment piece also helps maintain the cable means onto the pulley. Adjustment means may be secured to the cable means between the power source and the foot control steering means which is operative to adjust the tension on the cable means. The boat may comprise a plurality of storage compartments conveniently located within the boat. The plurality of storage compartments may comprise a bow storage compartment, two side storage compartments, and a center storage compartment. The power source is removeably attached to the boat by hinged support. The position that the hinged support holds the power source with respect to the boat is determined by a spring and can be adjusted by a plurality of trim screws. A plurality of bars may be secured to the sides of the boat to reinforce the strength of the boat.

The foot control steering means comprises a center post and a plurality of extensions extending from the center post outward and then downward. The feet of the person operating the boat may be placed against the plurality of extensions and the center post may be removeably attached to the boat. The center post may be attached in either of two positions 180° apart. The two different positions provide a defined change in distance between the seat and the foot control steering means in order to provide more comfortable leg room for the person operating the boat. A plurality of adjusting holes in the boat provides different positions for the center post to be attached. The seat provides a plurality of seat supports. A support rod is secured across the interior of the boat between the seat and the power source. A plurality of bolts on the support rod may press against the plurality of seat supports to firmly hold the seat in place. However, the plurality of seat supports are easily removed from the pressure of the plurality of bolts in order to fold the hingedly secured seat to a storage position. Flotation may be sealed into the bottom of the boat.

The invention will be more fully understood from the following detailed description and appended claims when taken with the drawings in which:

FIG. 1 is a side view of the boat 1 with a partial cut-away view of the center section of the boat 1, showing seat back 3 and seat bottom 4 in dotted lines.

FIG. 2 is a top view of the boat 1 shown in FIG. 1 with a partial cut-away view of the front storage compartment 34 and with seat back 3 and seat bottom 4 removed.

Figure 1:
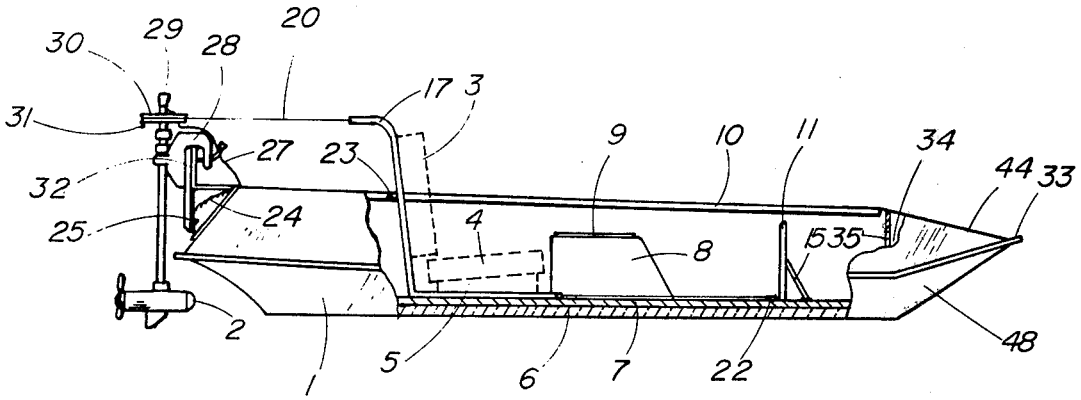

Referring now to the drawings, FIG. 1 is a side view of the boat 1 with a partial cut-away view of the center section of boat 1. Seat back 3 and seat bottom 4 are shown in dotted lines. Electric motor 2 is shown attached to the rear of boat 1. Storage compartment 5 is located beneath seat bottom 4. Storage compartment 5 is an open area under seat bottom 4. Seat bottom 4 is set on the floor in the interior of the boat. Flotation 6 is built into the bottom 7 of the boat 1. Live well 8 including a compartment attached near the center of the boat 1 has a lid 9. Live fish can be kept in the compartment 42. Boat 1 has a reinforcing bar 10 extending around the sides, and other reinforcing bars not shown, to increase the strength of the boat. Foot mechanism 11 controls the movement of electric motor 2 through cable 20.

Figure 2:
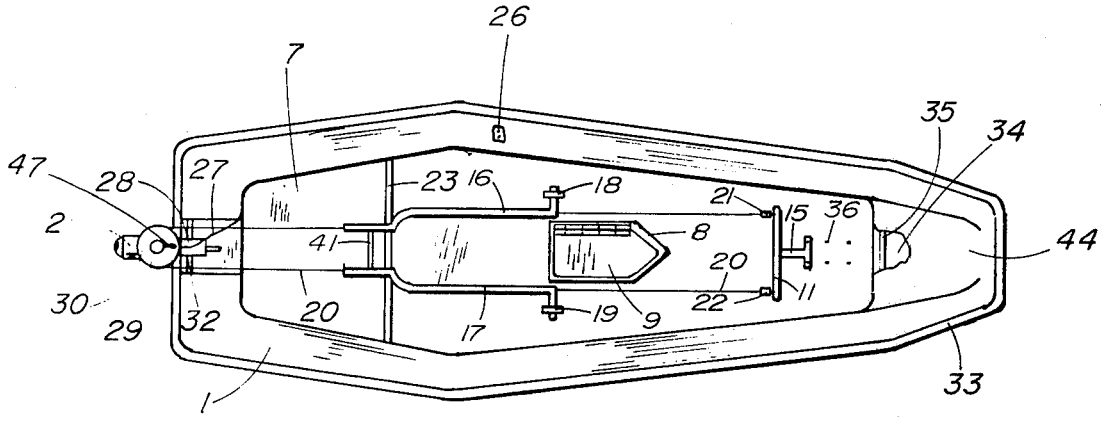

FIG. 2 shows a top view of the boat 1 that is shown in FIG. 1. FIG. 2 has a partial cut-away view of front storage compartment 34 in the bow of the boat. Opening 35 enables the operator of the boat to utilize the space within compartment 34 for storage or other desired purposes. Seat back 3 and seat bottom 4 have been removed in FIG. 2. The seat comprises seat support 16 and seat support 17. Seat support 16 is anchored to the bottom of the boat by anchor hinge 18. Seat support 17 is anchored to the bottom of the boat by anchor hinge 19. Support bar 41 extends between seat support 16 and seat support 17. Seat support 16 and seat support 17 are hollow so that cable 20 can extend through the seat supports 16 and 17 from the electric motor 2 to foot control steering means 11. Cable 20 within seat supports 16 and 17 is protected from entanglement by being within the hollow seat supports 16 and 17. Adjustment means 21 and 22 are connected to the ends of cable 20 at the foot control steering means 11. As shown in detail in FIG. 5, the foot control steering means 11 comprises extension 12, extension 13, and center post 14. The foot control steering means 11 is anchored by anchor 15. Anchor 15 is secured to the bottom of the boat 1. Anchor 15 has a hollow section in which center post 14 secures within.

Figure 4:
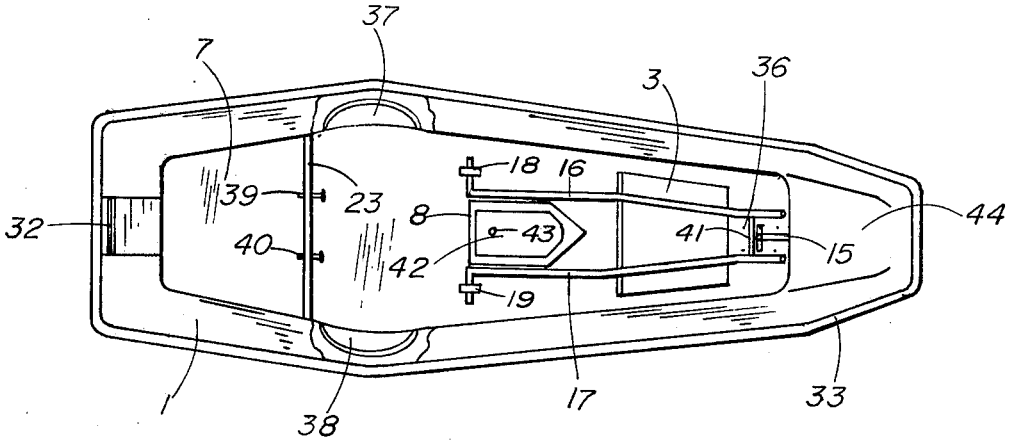
FIG. 4 is a top view of the boat showing partial cut-away views of two storage compartments 37 and 38 with the seat in the stored, folded, position, and the electric motor removed.
Figure 3:
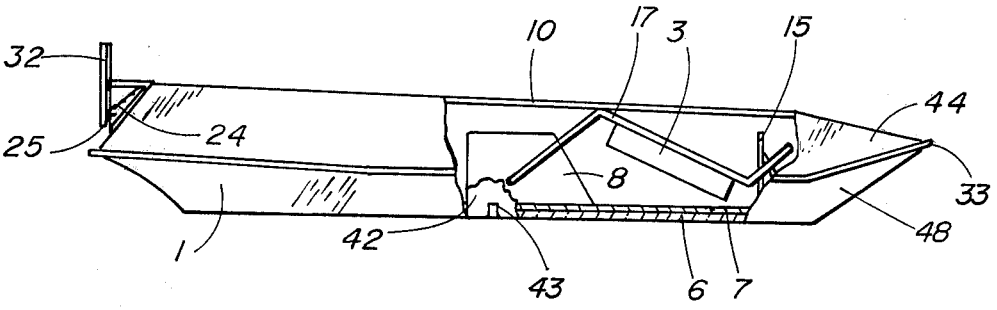
FIG. 3 is a side view of the boat showing the seat in a stored, folded, position with a partial cut-away view of the forward compartment, and a further partial cut-away view of the live well 8, and the electric motor removed.

FIG. 3 shows a side view of the boat 1 showing the seat in a stored, or folded, position. A partial cut-away view is shown of the forward compartment and a further partial cut-away view is shown of the live well 8. FIG. 4 is a top view.

In order to fold or store the seat for storage or transporting purposes, the boat is designed so that the seat may be easily folded. Foot control steering means 11 can be removed from anchor 15 by lifting the center post 14 from within the hollow section of anchor 15. Cable 20 may be removed from pulley 30. Electric motor 2 may be tilted to aid in that function. Anchor hinge 18 and anchor hinge 19 secures seat supports 16 and 17 in a manner that they may move within the anchor hinges 18 and 19. The seat may be folded, physically, as shown in FIG. 3, by pulling the seat away from support rod 23 and bolts 39 and 40. Bolt 39 is located on support rod 20 so that it fits snuggly against seat support 16 when the seat is in the up-right position. Bolt 40 is placed on support rod 23 so that it fits snuggly against seat support 17 when the seat is in the up-right position. When the seat is to be folded, seat supports 16 and 17 may be physically pulled away from the securing bolts 39 and 40 on support rod 23. The top opening of the boat 1 is so designed that the seat will fold down into the boat for storage or transporting.

Live bait well 8 has an inner compartment 42 within which an opening 43 is located. Opening 43 may be adjusted so that a desired amount of water may enter from underneath the boat 1. Opening 43 allows water to enter so that fish may be stored within the live bait well 8 in compartment 42 in a live state.

FIG. 4 is a top view of the boat as shown in FIG. 3. Storage compartments 37 and 38 are shown in partial cut-away views. Storage compartments 37 and 38 give further storage capability to the boat and aids in its versatility.

Figure 5:
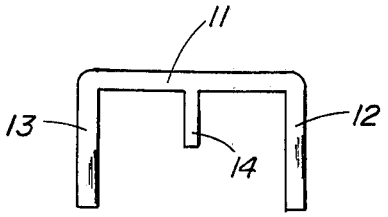
FIG. 5 is a plane view of a portion of the foot mechanism 11 for the boat.

FIG. 5 shows a plane view of the foot control steering means 11 of the boat as previously discussed. Extensions 12 and 13 and center post 14 are shown. Center post 14 may be attached to foot control steering means anchor 15 in either of two positions 180° apart. Extensions 12 and 13 extend outward from center post 14 and then downward. The outward portion of the extensions 12 and 13 is curved, therefore, depending upon which position 180° apart center post 14 is removeably attached to foot control steering means anchor 15 of boat 1, the distance between the seat and the foot control steering means 11 will be different by a defined amount. The plurality of adjusting holes 36 in boat 1 in which foot control steering means anchor 15 is secured to boat 1 provide an even greater flexibility to adjust the length of leg room required by the individual person operating the boat.

Figure 6:
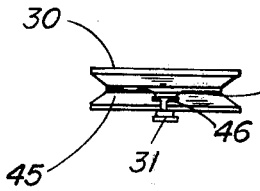
FIG. 6 is a rear view of the pulley 30.

FIG. 6 is a rear view of pulley 30 showing slot 46 in bottom section 45 of pulley 30. Cable 20 extends through slot 46 and connects to center adjustment 31 which is tied into cable 20. Cable 20 then continues back through slot 46 and around pulley 30, connecting to the foot control steering means 11.

Figure 7:
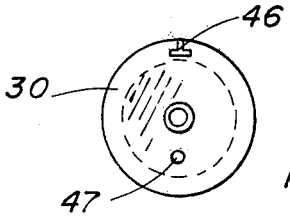
FIG. 7 is a bottom view of the pulley 30.

FIG. 7 is a bottom view of pulley 30 showing slot 46 and hole 47. Electrical cable 27 is connected through hole 47 in pulley 30. Electrical cable 27 is connected to the electric motor 2 and to switch means 26. Switch means 26 is located on the outer portion of the boat at a convenient location for the person operating the boat. The switch means may be located at any convenient location as desired. The electric motor 2 is removeably attached to hinge support 32 which is secured to boat 1. Spring 24 controls the hinge support 32 so that the hinge support 32 may be moved and the spring 24 will return it to the original position. Trim screw 25, and another trim screw not shown, are adjustments controlling the position that the spring 24 will hold hinge support 32. The electric motor 2 can, therefore, be adjusted to the proper position to properly drive boat 1. The electric motor 2 may be attached to the hinge support 32 by motor clamp 28. Motor shaft 29 extends above pulley 30.

The boat is designed for maximum stability. The bow of the boat has a lip which comprises an angled bow 44 with lower bow portion 48. A stabilizing lip and molding 33 extends around the boat. The bow portion is designed to prevent wakes from blowing over the front of the boat.

The boat is adjustable in many ways for the convenience of the person operating the boat. The foot control steering means anchor 15 may be secured into any of the holes 36 that is desired by the person operating the boat in order to provide maximum comfort for the feet and legs of the operator.

A battery or other electrical power source should be wired directly to the electric motor 2 through switch means 26.

Drainage plugs may be secured to the bottom of the boat as desired.

The foot control steering means anchor 15 may be designed so that it may be secured to the boat in two positions 180° apart. The anchor 15 may be designed so that the two different securing positions would give further flexibility in providing a different amount of leg room for the boat operator.

This invention is basically a boat which may be operated by one person. Electric motor 2 has been shown; however, any power source desired may be used. The details of the seat can be changed to any seat which is hingedly secured to the boat. Any type of foot control steering means can be used. The boat may be maneuvered by use of the foot control steering means. In the preparation for transporting or storing, the foot control steering means may be easily removed, the hingedly secured seat easily folded and the power source, such as the electric battery, easily removed. This boat meets the objectives set forth for it in that it is very stable and very convenient.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A boat which may be operated by one person comprising:

(a) a removeably attached power source operative to drive said boat;

(b) a control system including a hollow seat support whereby said control system may be dismantled by folding said hollow seat support;

(c) foot control steering means removeably attached to said boat; and (d) cable means connected from said foot control steering means through the interior of said hollow seat support to said power source whereby said boat may be maneuvered by use of said foot control steering means and the preparation for transporting or storing said boat may include removing said foot control steering means, folding said hingedly secured seat, and removing said power source.

2. A boat according to claim 1 further comprising a wet storage compartment suitable for storing live fish or bait.

3. A boat according to claim 2 wherein said wet storage compartment is positioned in said boat between the legs of said person operating said boat.

4. A boat according to claim 1 further comprising a lip on the bow of said boat operative to prevent wakes from blowing over the front of said boat.

5. A boat according to claim 4 further comprising a stability lip completely surrounding said boat and operative to stablize said boat.

6. A boat according to claim 1 further comprising switch means located on the outer portion of said boat operative to control said power source whereby said person operating said boat may conveniently control said power source.

7. A boat according to claim 1 further comprising a pulley secured to said power source.

8. A boat according to claim 7 further comprising a slot in said pully for use in aligning said foot control steering means with said power source.

9. A boat according to claim 8 further comprising a center adjustment piece secured onto said cable means, operative to aid in aligning said foot control steering means with said power source, and to help maintain said cable means onto said pulley.

10. A boat according to claim 1 further comprising adjustment means secured to said cable means between said power source and said foot control steering means, operative to adjust the tension on said cable means.

11. A boat according to claim 1 further comprising a plurality of storage compartments conveniently located within said boat.

12. A boat according to claim 11 wherein said plurality of storage compartments comprise a bow storage compartment, two side storage compartments, and a center storage compartment.

13. A boat according to claim 1 wherein said power source is removeably attached to said boat by a hinged support.

14. A boat according to claim 13 wherein the position that said hinged support holds said power source with respect to said boat is determined by a spring.

15. A boat according to claim 14 wherein said position that said hinged support holds said power source with respect to said boat is adjustable by a plurality of trim screws.

16. A boat according to claim 1 further comprising a plurality of bars secured to the sides of said boat operative to reinforce the strength of said boat.

17. A boat according to claim 1 wherein said foot control steering means comprises a center post and a plurality of extensions extending from said center post outward and then downward, whereby the feet of said person operating said boat may be placed against said plurality of extensions and said center post may be removeably attached to said boat.

18. A boat according to claim 17 wherein said center post may be removeably attached in either of two positions 180° apart thereby providing a defined change in distance between said seat and said foot control steering means to provide more comfortable leg room for said person operating said boat.

19. A boat according to claim 18 further comprising a plurality of adjusting holes in said boat whereby said center post may be removeably attached at different positions in said boat.

20. A boat according to claim 1 wherein said seat comprises a plurality of seat supports.

21. A boat according to claim 20 further comprising a support rod which is secured across the interior of said boat between said seat and said power source, and a plurality of bolts on said support rod operative to press against said plurality of seat supports to firmly hold said seat in place whereby said plurality of seat supports are easily removed from the pressure of said plurality of bolts in order to fold said hingedly secured seat to a storage position.

22. A boat according to claim 1 wherein said boat further comprises flotation sealed into the bottom of said boat.

23. A boat according to claim 1 wherein said power source is an electric motor.

* * * * *